US006015014A

United States Patent [19]

Macleod et al.

[11] Patent Number: 6,015,014

[45] Date of Patent: Jan. 18, 2000

[54] DOWNHOLE LUBRICATOR AND METHOD

[75] Inventors: Allan Macleod; Mark McCorry; Graeme Falconer, all of Aberdeen, United Kingdom

[73] Assignee: Baker Hughes Incorporated, Houston, Tex.

[21] Appl. No.: 08/862,073

[22] Filed: May 22, 1997

[30] Foreign Application Priority Data

May 29, 1996 [GB] United Kingdom ..... 9611133

[51] Int. Cl.[7] ..... E21B 34/06

[52] U.S. Cl. ..... 166/374; 166/321

[58] Field of Search ..... 166/321, 329, 166/373, 332.5, 323, 313, 322, 372, 385, 324, 242.2, 386, 374; 137/613

[56] References Cited

U.S. PATENT DOCUMENTS

| | | | |
|---|---|---|---|
| Re. 25,471 | 11/1963 | Fredd . | |
| 4,116,272 | 9/1978 | Barrington . | |
| 4,253,525 | 3/1981 | Young . | |
| 4,273,186 | 6/1981 | Pearce et al. . | |
| 4,311,197 | 1/1982 | Hushbeck . | |
| 4,368,871 | 1/1983 | Young . | |
| 4,378,850 | 4/1983 | Barrington . | |
| 4,415,036 | 11/1983 | Carmody et al. . | |
| 4,427,071 | 1/1984 | Carmody . | |
| 4,444,268 | 4/1984 | Barrington . | |
| 4,448,254 | 5/1984 | Barrington . | |
| 4,469,179 | 9/1984 | Crow et al. . | |
| 4,473,122 | 9/1984 | Tamplen . | |
| 4,476,933 | 10/1984 | Brooks . | |
| 4,522,370 | 6/1985 | Noack et al. . | |
| 4,531,587 | 7/1985 | Fineberg . | |
| 4,577,694 | 3/1986 | Brakhage, Jr. | 166/382 |
| 4,579,174 | 4/1986 | Barrington . | |
| 4,595,060 | 6/1986 | Beck . | |
| 4,603,742 | 8/1986 | Wong et al. . | |
| 4,618,000 | 10/1986 | Burris, II . | |
| 4,619,325 | 10/1986 | Zunkel . | |
| 4,624,317 | 11/1986 | Barrington . | |
| 4,655,268 | 4/1987 | Burris, II et al. . | |
| 4,665,991 | 5/1987 | Manke . | |
| 4,711,305 | 12/1987 | Ringgenberg . | |
| 4,825,902 | 5/1989 | Helms . | |
| 4,846,281 | 7/1989 | Clary et al. . | |
| 4,856,558 | 8/1989 | Kardos . | |
| 4,903,775 | 2/1990 | Manke . | |
| 4,986,358 | 1/1991 | Lueders et al. . | |
| 5,159,949 | 11/1992 | Prescott et al. . | |
| 5,201,371 | 4/1993 | Allen . | |
| 5,203,410 | 4/1993 | Cobb et al. . | |
| 5,213,125 | 5/1993 | Leu . | |
| 5,411,096 | 5/1995 | Akkerman . | |
| 5,465,786 | 11/1995 | Akkerman . | |
| 5,848,646 | 12/1998 | Huber et al. | 166/379 |
| 5,857,523 | 1/1999 | Edwards | 166/379 |

FOREIGN PATENT DOCUMENTS 2286840 8/1995 United Kingdom .

OTHER PUBLICATIONS

Tim Walker, et al., Downhole Swab Valve Aids in Underbalanced Completion of North Sea Well, SPE 30421, Society of Petroleum Engineers, Inc., 1995, 3 pages.

Tim Walker, et al., Underbalanced Completions Improve Well Safety and Productivity, World Oil, Nov. 1995, 4 pages.

*Primary Examiner*—William Neuder

*Attorney, Agent, or Firm*—Duane, Morris & Heckscher LLP

[57] ABSTRACT

The invention is an assembly which is run into the wellbore to straddle pre-existing control line connections used normally for actuation of a sleeve for a single subsurface safety valve. The lower flapper is closed through the use of one of the control lines. It is then tested against formation pressure to make sure that it holds. Upon determination that the lower flapper is holding, the upper flapper is shut off using the other control line. By adding additional pressure to the control line for the lower sleeve, further movement of the lower sleeve is obtained to urge another sleeve into contact with the upper flapper to provide support for it so that it can be tested from above. Once the two flappers have been tested, uphole assembly in the wellbore can begin through the wellhead in the zone above the tested valves once assembled. Coiled tubing or wireline can be advanced sealingly through the wellhead as the assembly is lowered past the flappers which are now allowed to open. The flapper assembly is eventually removed.

25 Claims, 8 Drawing Sheets

DOWNHOLE LUBRICATOR AND METHOD

FIELD OF THE INVENTION

The field of this invention relates to downhole shutoff valves, particularly valve assemblies suitable for shutting off formations in under-balanced wells to allow for uphole assembly of equipment for subsequent operations in the wellbore.

BACKGROUND OF THE INVENTION

During the life of the well, completion work may need to occur to allow access to hydrocarbon reservoirs at various elevations, or for other reasons. If a well has access to a hydrocarbon reservoir which creates a pressure in the wellbore, access into the wellbore above this reservoir needs to occur with the lower reservoir isolated. Some wells are under balanced, meaning that, while the completion work is ongoing, the formation pressure from the producing reservoir is not offset by a column of liquid in the wellbore. Instead, in oil or gas wells the pressure from the formation needs to be isolated positively with two shutoffs before the wellhead can be opened up so that further completion work can occur. In the past, this has been accomplished with a lubricator above the wellhead. A lubricator is a chamber with valves on top and bottom which is limited in height to about 60'–80' so that tools can be hoisted into the top of it. Using lubricators limits the length of a downhole assembly and creates delays if long strings of such equipment as perforating guns are required. Single flapper subsurface safety valve arrangements are not satisfactory since dual isolation is required before the under-balanced wellbore can be accessed through the wellhead while meeting existing regulations. In a typical installation, a pair of control lines are run from the surface into a portion of the casing for operation of a known single flapper subsurface safety valve. Such control lines are used in the present invention to operate a removable valve assembly to allow long strings of tools to be assembled in the wellbore through an open wellhead.

If dual valves are used, each must be tested. The problem in the past with a dual valve arrangement has been that once the lower valve is closed and tested, the upper valve is not exposed to well pressure and cannot be tested from below. This invention solves this problem by testing the upper valve from above.

The object of the present invention is to provide a dual shutoff system with facilities to pressure test the two shutoffs to ensure their integrity. The system employs existing control line connections and has as another of its objectives that it be removable.

SUMMARY OF THE INVENTION

The invention is an assembly which is run into the wellbore to straddle pre-existing control line connections used normally for actuation of a sleeve for a single subsurface safety valve. The lower flapper is closed through the use of one of the control lines. It is then tested against formation pressure to make sure that it holds. Upon determination that the lower flapper is holding, the upper flapper is shut off using the other control line. By adding additional pressure to the control line for the lower sleeve, further movement of the lower sleeve is obtained to urge another sleeve into contact with the upper flapper to provide support for it so that it can be tested from above. Once the two flappers have been tested, uphole assembly in the wellbore can begin through the wellhead in the zone above the tested valves. Once assembled, coiled or rigid tubing or wireline can be advanced sealingly through the wellhead as the assembly is lowered past the flappers which are now allowed to open. The flapper assembly is eventually removed.

DETAILED DESCRIPTION OF THE PREFERRED EMBODIMENT

Figure 1A:
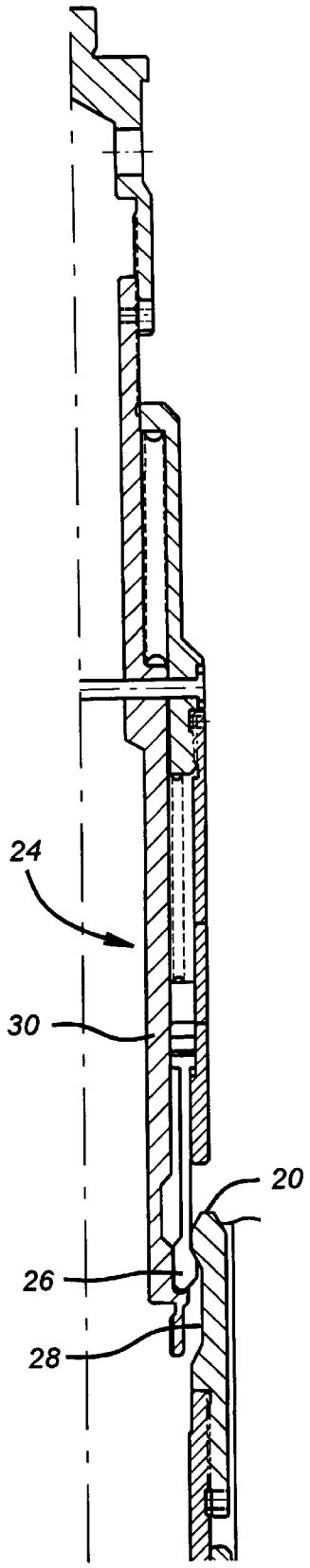
FIGS. 1*a*–1*e* are a sectional elevational view of the assembly installed in the casing with both flappers open.
Figure 2A:
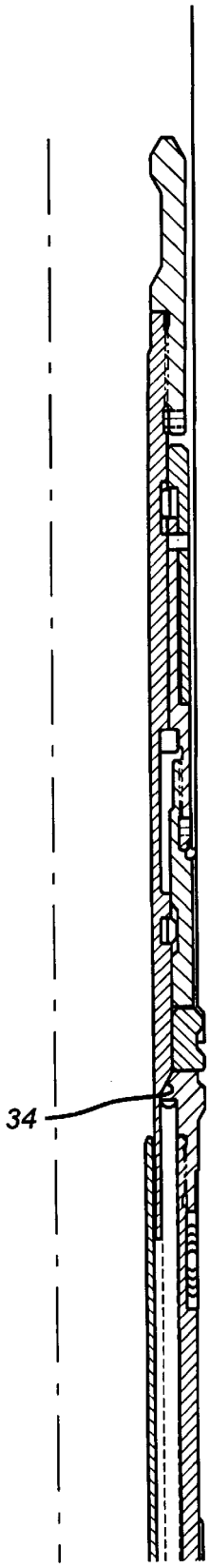
FIGS. 2*a*–2*d* are the sectional elevational view of FIGS. 1*a*–1*e* with the running tool removed and the lower flapper in the closed position.
Figure 1B:
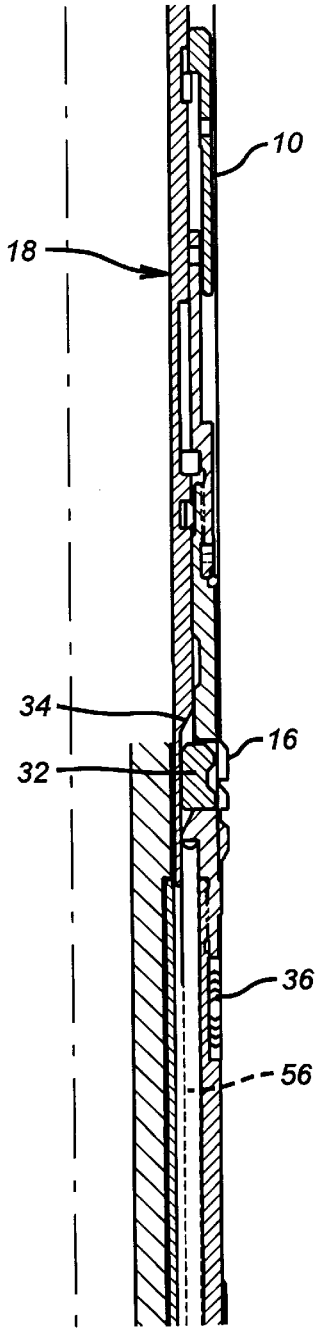

The production tubing 10 is illustrated in part in FIGS. 1*a*–1*d*. Typically, the production tubing 10 has control lines 12 and 14 which run to the surface for actuation of a single subsurface safety valve (not shown). The production tubing 10 generally has an internal profile 16, which is generally used for latching in the normal assembly for a subsurface safety valve. In the present invention, the flapper assembly 18 extends from upper end 20 to lower end 22. The flapper assembly 18 is run in with a known running tool 24. The running tool 24 has a series of collets 26 which engage a recess 28 near the upper end 20 of the flapper assembly 18. The collets 26 are supported by a movable sleeve 30, and in the position shown in FIG. 1*a,* the running tool 24 is latched into and locked to the upper end 20 of the flapper assembly 18.

Figure 2B:
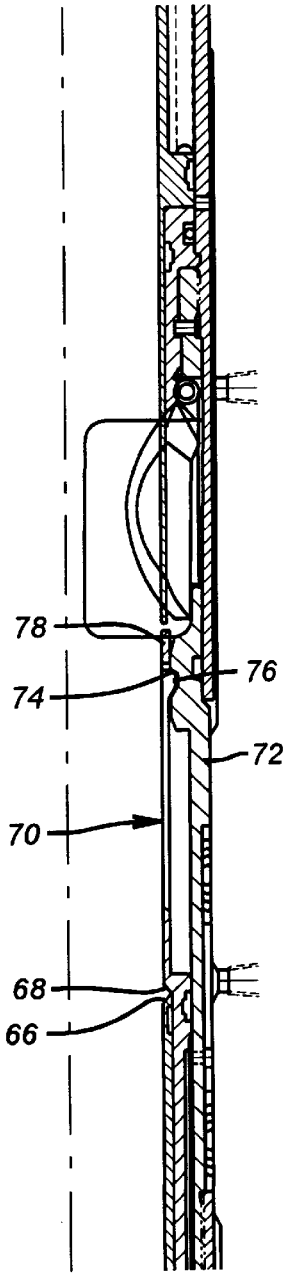

The flapper assembly 18 also has a series of dogs 32, which have a front profile similar to the profile 16 in the production tubing 10 so as to land and latch the flapper assembly 18 to the production tubing 10. The latched position is shown in FIG. 2*b,* where tapered surface 34 has advanced under dogs 32, effectively camming them into the profile 16.

The flapper assembly 18 has a series of external seals 36, 38, and 40 which align themselves appropriately straddling inlets 42 and 44. Control line 12 is connected to inlet 42, while control line 14 is connected to inlet 44. Seals 38 and 40 straddle inlet 44, while seals 38 and 36 straddle inlet 42.

Figure 3A:
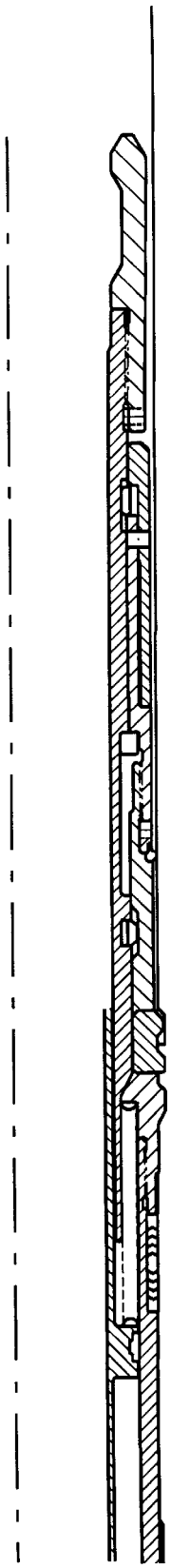
FIGS. 3*a*–3*d* are the tool, as shown in FIG. 2, with both flappers closed and the upper flapper ready for test.
Figure 3B:
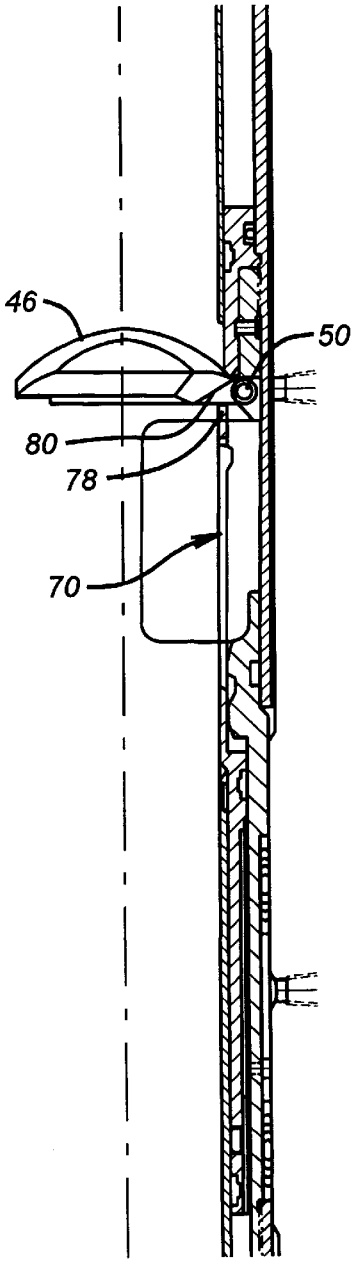

The flapper assembly 18 includes an upper flapper 46 and a lower flapper 48. While flapper-style valves are illustrated, other types of valves are within the scope of the invention and within the scope of the word "flapper" as used in this application. Flapper 46 pivots around pivot 50 and is urged to the closed position, such as shown in FIG. 3*b,* by spring 52. Upper sleeve 54 is normally urged downwardly to the position shown in FIGS. 1*b* and 1*c* by spring 56. Pressure applied to inlet 42 through control line 12 overcomes the force spring 56 lifting the sleeve 54 upwardly which, in turn, allows the flapper 46 to snap shut, as illustrated in FIG. 3*b*.

Figure 1C:
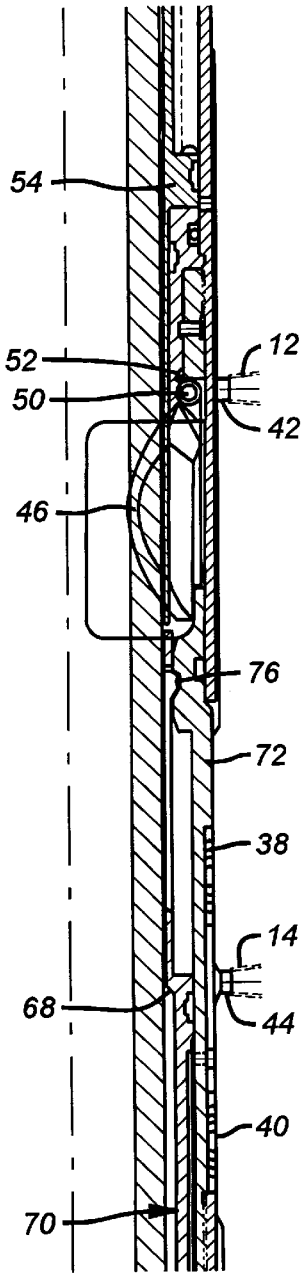
Figure 3C:
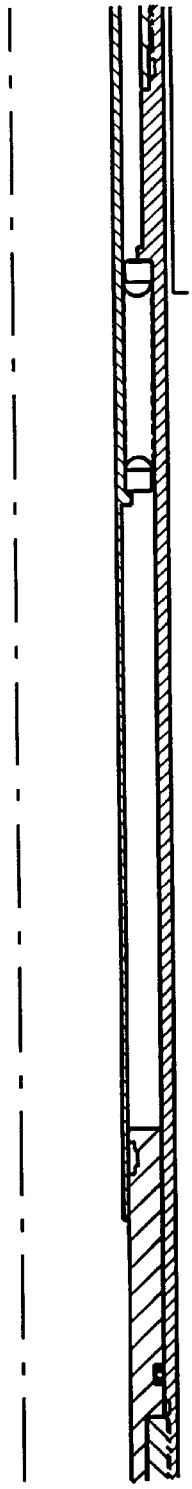
Figure 2C:
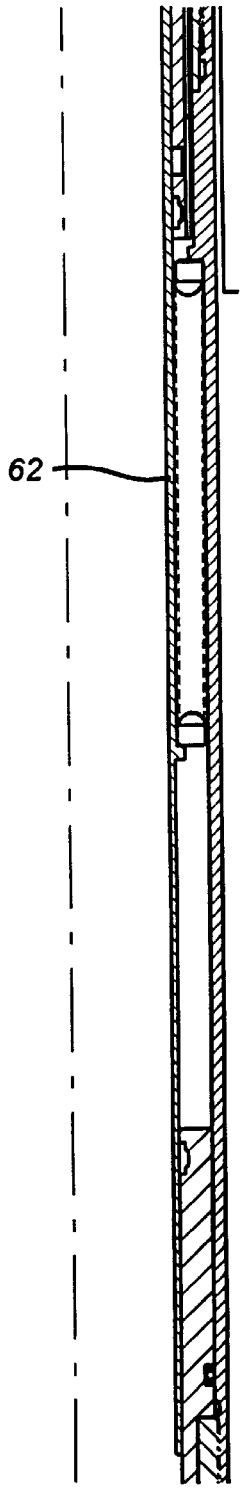
Figure 1D:
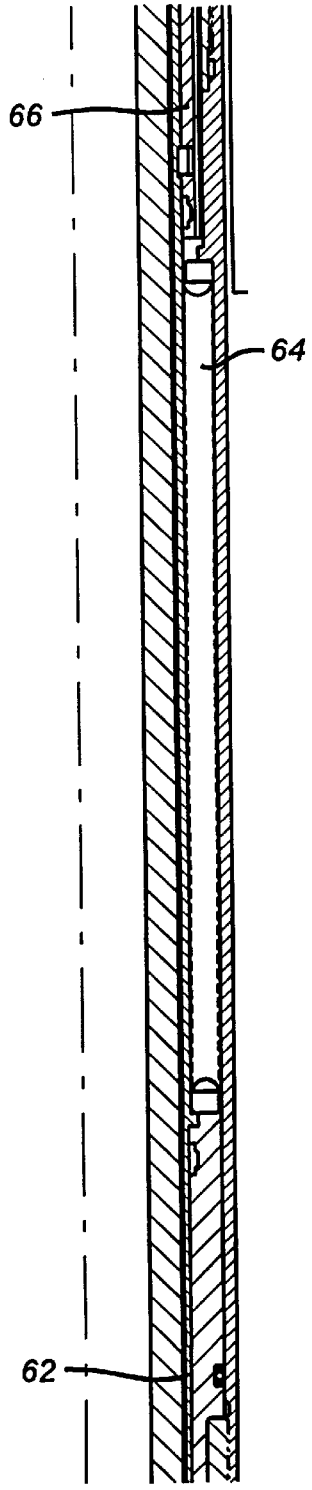
Figure 3D:
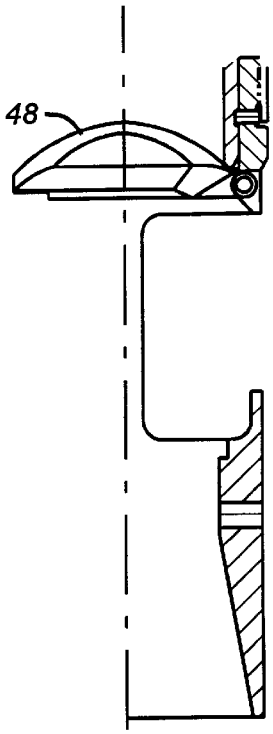
Figure 2D:
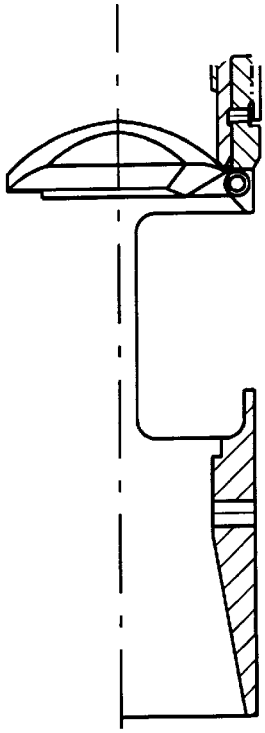
Figure 1E:
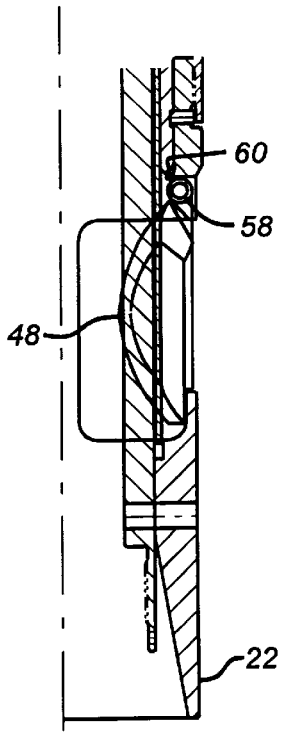

A similar arrangement exists for the lower flapper 48. Flapper 48 pivots around pivot 58 and is urged into the closed position by spring 60. Lower sleeve 62 prevents rotation of flapper 48 due to the force of spring 64. Fluid pressure applied to inlet 44 from control line 14 acts to shift up sleeve 62 against the force of spring 64 to allow spring 60 to close the flapper 48, as shown in FIG. 2*d*. Sleeve 62 has an upper end 66 which, in the run-in position, as shown in FIGS. 1*c* and 1*d*, is at a distance from tapered surface 68 on support sleeve 70. As seen by comparing FIGS. 1*c* and 1*d* with 2*b* and 2*c,* the opening of the lower flapper 48 results in movement of sleeve 62 in an upward direction so that the upper end 66 makes contact with tapered surface 68. The support sleeve 70 is initially held to the body 72 of the apparatus of the present invention. The upper end of the support sleeve 70 comprises a plurality of protrusions or collets 74 which are normally retained by an annularly-shaped recess 76. The support sleeve 70 has an upper end 78 which, as shown in FIG. 3*b,* supports the flapper 46 when it is in the closed position.

The operation of the apparatus and method of the present invention is as follows. The running tool 24 is used to insert the flapper assembly 18 into the production tubing 10. The dogs 32 are engaged into the profile 16. Pressure is applied through control line 14 into inlet 44. The application of this pressure shifts the sleeve 62 upwardly, allowing spring 60 to rotate flapper 48 about pivot 58. The movement of sleeve 62 and flapper 48 can be readily seen by comparing FIG. 1*d* and 1*e* to FIG. 2*c* and 2*d*. It should be noted that the pressure applied to the control line 14 is approximately in the order of 1,000 pounds. This pressure is sufficient to move up the sleeve 62, but is less than the pressure ultimately required to move sleeve 62 to the point where it moves support sleeve 70 out of contact with recess 76. There is a lost motion between sleeves 62 and 70. That is, that sleeve 62 while engaged to sleeve 70 can move a fixed distance before both sleeves move in tandem.

This is true in both directions of movement of sleeve 62.

With the lower flapper 48 closed, its sealing off of the production tubing 10 can be measured at the surface using the pressure created by the live well in which the production tubing 10 is located. If such a test reveals that there is no leakage, pressure is then applied to the control line 12 which is connected to inlet 42. Sleeve 54 is shifted upwardly due to the applied pressure at inlet 42 which allows spring 52 to pivot flapper 46 about pivot 50. This movement can be seen by comparing FIG. 2*d* to FIG. 3*d*. When the upper flapper 46 is closed, the well has already been isolated down below by the prior closure of flapper 48. Accordingly, pressure created from the formation cannot be used to test the sealing engagement of flapper 46 from below if flapper 48 is already closed.

Accordingly, the support sleeve 70 now comes into play as pressure is further increased on control line 14 connected to inlet 44. The pressure may be increased to, for instance, 2,000 lbs from 1,000 lbs on control line 14. This pressure increase will urge sleeve 62 upwardly until a resultant force is applied to support sleeve 70 when upper end 66 engages tapered surface 68. The position of the components just before movement of support sleeve 70 is shown in FIG. 2*b*. Upon increase in pressure to control line 14, the support sleeve 70 is driven upwardly until it contacts the underside 80 of flapper 46. In order to get to this position, the applied force to the support sleeve 70 exceeds the retention force of the protrusions 74 in the annularly-shaped recess 76. Now, with the upper end 78 in contact with the underside 80 of the flapper 46, pressure from above can be applied to see if any leakage occurs. Once it is determined that upper flapper 46 is also in a sealing mode, the entire distance in the production tubing 10 above the upper flapper 46, which is now doubly isolated from well pressure, can serve as a lubricator for assembly of tools, such as perforating guns. Normally, if a surface-mounted lubricator is used, the string that is assembled through a lubricator is limited to approximately 60–80 feet. If perforation is to take place in the wellbore in an under-balanced condition, and the perforation is over an interval of say 1,000 feet, the use of a lubricator would inordinately delay accomplishing such a perforation job as only 60–80 feet of guns can be assembled at a time through the lubricator and run into the well on coiled tubing or wireline.

Another option is to simply kill the well with heavy fluids, but a risk occurs that in the future when such fluids are removed damage could occur to the formation which could affect the future performance of the well. Instead, using the apparatus of the present invention with the flapper assembly 18 in the wellbore and the production tubing 10 in a fully tested condition with flappers 46 and 48 closed and sealing, the entire distance from the surface to the upper flapper 46 can be employed to assemble any length of equipment within that interval. In a typical installation, the connections 42 and 44 are between 1,000–2,000 feet from the surface. Accordingly, a string having that kind of a span can be assembled through the wellhead and the 1,000–2,000 foot span above the closed flappers 46 and 48 in effect becomes a very long lubricator in lieu of one typically used above ground, which has height limitations due to rig heights, which are used to insert items into the top of such surface-mounted lubricators. Once the assembly is put together and run-in through the wellhead (not shown) and supported by, for example, coiled tubing, the assembly, now sealingly isolated at the wellhead, can be lowered through flappers 46 and 48 which are opened by removal of pressure from control lines 12 and 14. It should be noted that the removal of pressure in control line 12 starts the flapper 46 rotating counterclockwise and pushes down support sleeve 70. Additionally, removal of pressure from control line 14 allows the spring 64 to pull sleeve 62 downwardly. Sleeve 62 and sleeve 70 can be configured such that when sleeve 62 reaches the position shown in FIGS. 1*c*–1*e*, it pulls down with it sleeve 70. Thus, the preferred sequence of operations is removal of pressure from control line 14 which allows spring 64 to push down sleeve 62 to open flapper 48. On the way down, sleeve 62 carries with it support sleeve 70. Thereafter, pressure is removed from control line 12 which allows spring 56 to push down sleeve 54 to open upper flapper 46. The coiled tubing which supports the assembly that has earlier been run above the two flappers 46 and 48 is in itself mounted in a way that it is sealed at the wellhead. Accordingly, the assembly that has been put together above flappers 46 and 48 can now be positioned as desired in the wellbore. For example, a series of perforating guns that is 800–1,500 feet long, for example, can be assembled above closed flappers 46 and 48 with the wellhead open and the well, itself, in a live condition. For removal, the above process is reversed, i.e., the assembly of the perforating guns is brought above flappers 46 and 48 and they are allowed to close. They can then be tested and excess pressure vented at the wellhead. The gun assembly can then be removed. It should be noted that the flapper assembly 18 can at the conclusion of the operations with, for example, the gun assembly, can be removed from the wellbore and a standard subsurface safety valve installed which can be operated with control lines 12 and 14.

Figure 4A:
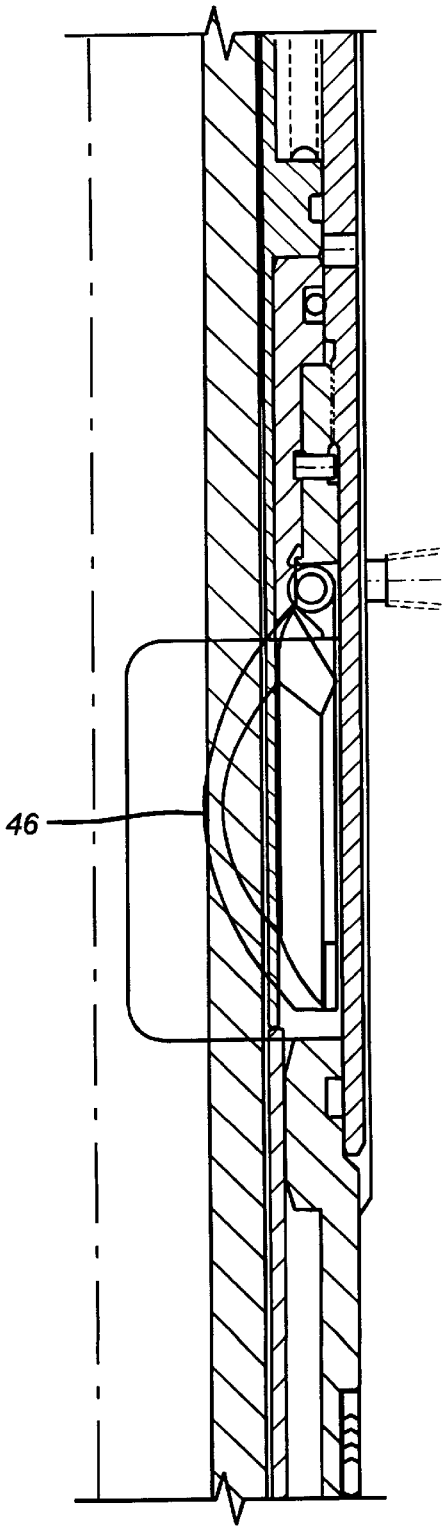
FIGS. 4*a*–4*e* are the run-in position of the preferred embodiment for support of the upper flapper.
Figure 4B:
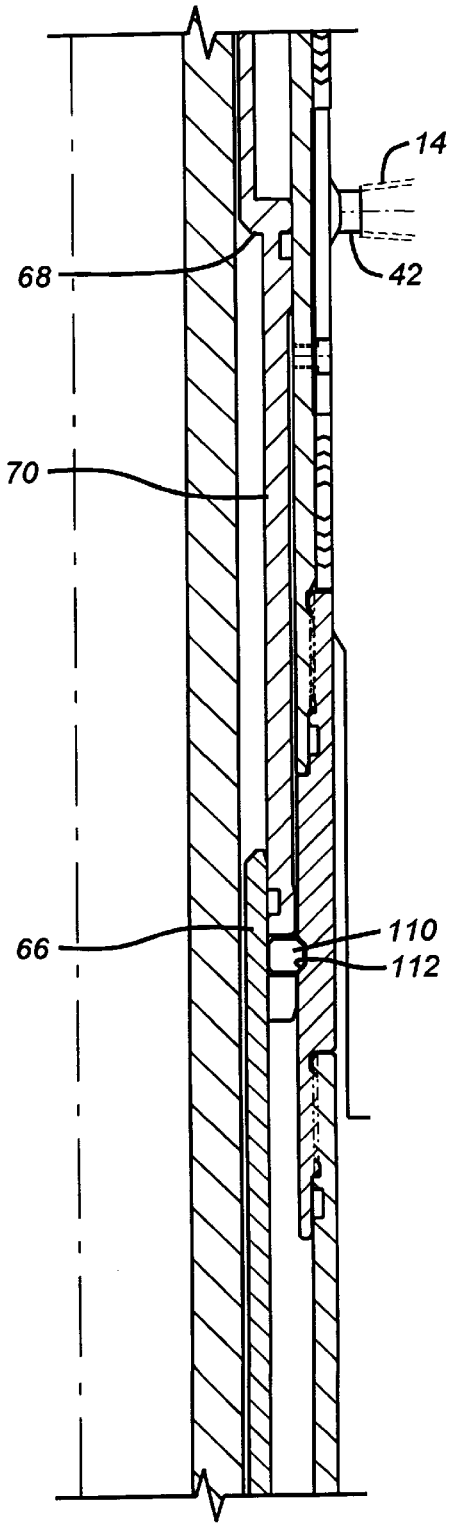
Figure 4C:
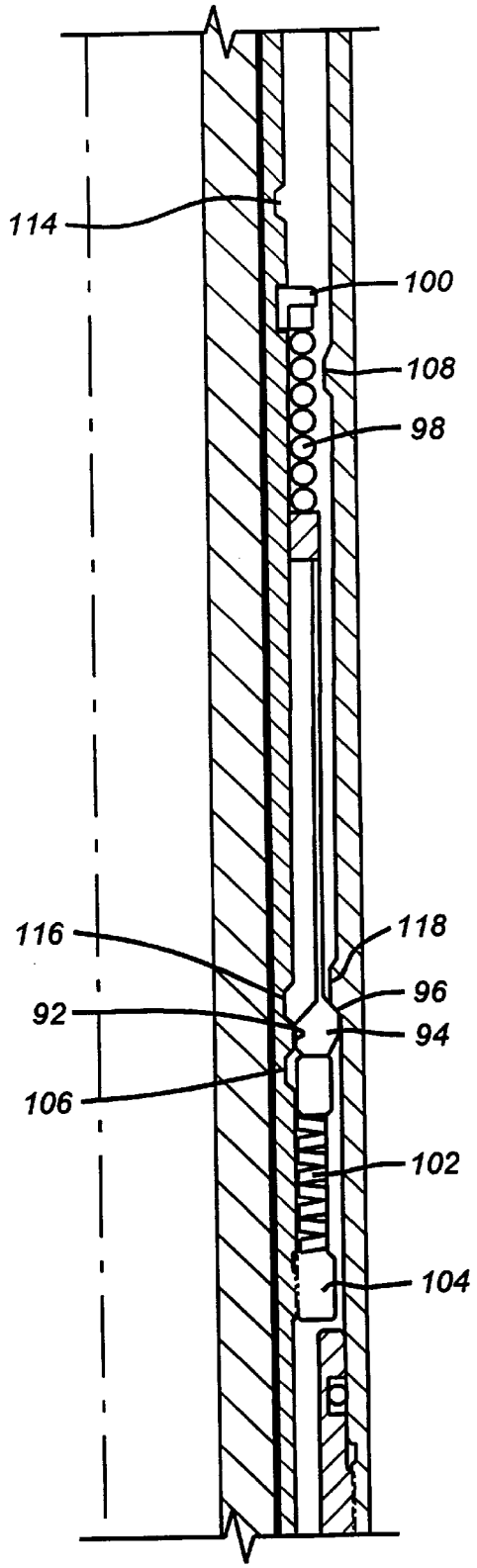
Figure 4D:
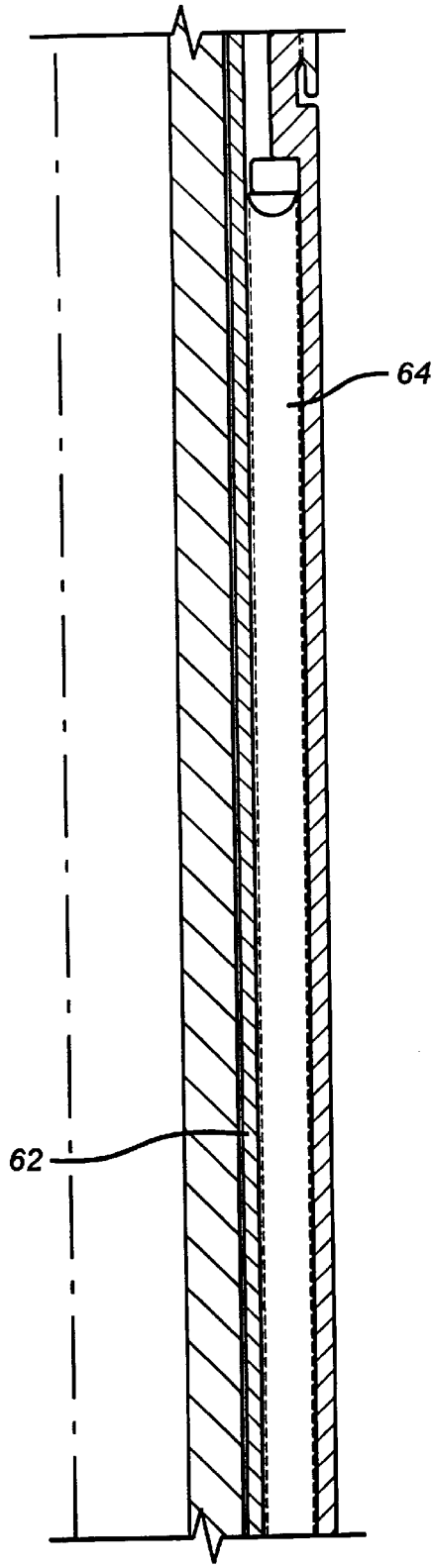
Figure 4E:
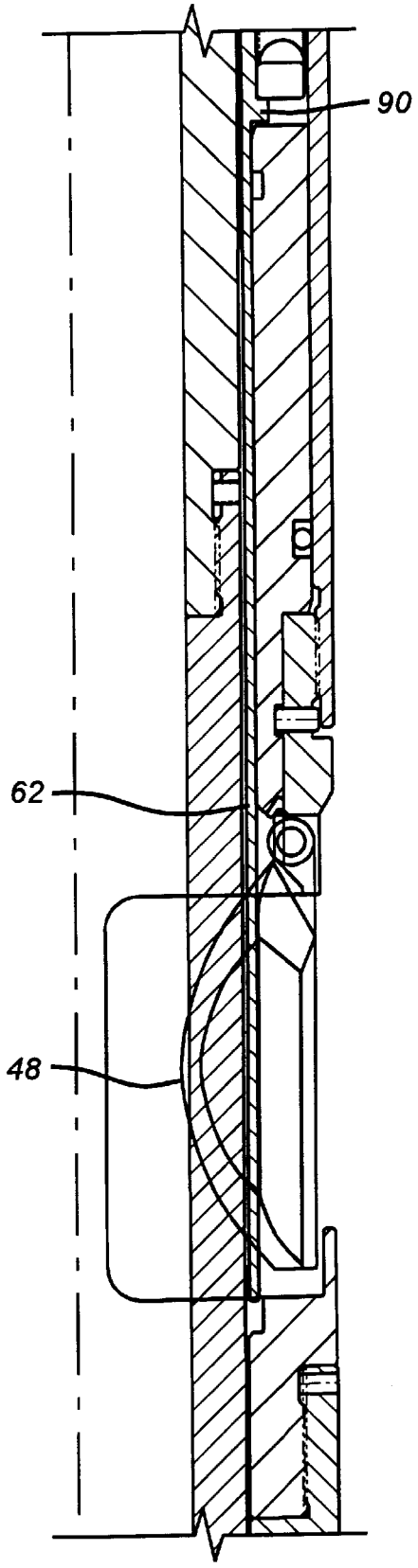

Referring to FIGS. 4*a*–4*e,* the preferred embodiment of the support of the upper flapper 46 is disclosed. The numbers will be repeated where the structures are the same with new numbers assigned to different components or configurations of the parts previously described. Spring 64 acts on tab 90 which is attached to the lower sleeve 62. In that manner, spring 64 biases sleeve 62 downwardly to hold the lower flapper 48 open as shown in FIG. 4*e*. When pressure is first applied to control line 14 and into inlet 42, the sleeve 62 cannot initially move because raised surface 92 traps collet 94 against a shoulder 96. The collet or collets 94 are downwardly biased by spring 98 which is itself supported from ring 100. Ring 100 is mounted to the sleeve 62. Below the collets 94 is a stack of Belleville washers 102. The stack of Belleville washers is supported by ring 104 which is connected to sleeve 62. As pressure increases in control line 14, the sleeve 62 will try and rise up, but its upward movement will be prevented because the collets 94 are trapped by shoulder 96.

Eventually upon application of sufficient pressure, the Belleville washers 102 will be compressed flat to allow the collets 94 to move downwardly into recess 106 on the sleeve 62. When that occurs, the collets 94 are no longer trapped by shoulder 96 and are free to move upwardly until they encounter shoulder 108. Thus, the sleeve 62 moves in tandem with collets 94 when the collets 94 are within the recess 106. As soon as the collets 94 are clear of the shoulder 96, spring 98 pulls the collets back up against the raised surface 92. In that position, the collets 94 encounter the shoulder 108. Accordingly, with the collets 94 again supported after clearing the shoulder 96, they lock again against shoulder 108. By the time the collets 94 have become trapped on shoulder 108, the sleeve 62 is moved a sufficient distance to allow the lower flapper 48 to open. However, during this time, the support sleeve 70 has not moved because dogs 110 engage groove 112. The upper end 66 of sleeve 62 supports the dogs 110 into engagement with the recess of groove 112. Accordingly, the sleeve 62 is free to move up the distance between the upper end 66 and the shoulder or tapered surface 68 on support sleeve 70. In order to move the support sleeve 70, the pressure must be increased on control line 14. This increase in pressure once again allows the collets 94 to move into recess 106 as the pressure is placed on sleeve 62 to move further upwardly. Once sleeve 62 moves upwardly sufficiently to have the collets 94 once again retreat into recess 106, the shoulder 108 can be cleared by collet 94. Thus, with collet 94 once again within recess 106, sleeve 62 moves further upwardly until recess 114 on sleeve 62 comes up against the dogs 110. At that time, the dogs 110 become unsupported and move out of recess or groove 112. With pressure continuing to be applied at control line 14, the sleeve 62 moves upwardly now in contact with shoulder 68 of support sleeve 70. Support sleeve 70 continues to move until it encounters the upper flapper 46 which by that time has already been closed due to application pressure to the upper control line 12. When the support sleeve 70 is in the position of supporting the upper flapper 46 in the closed position, a test on the upper flapper from the surface can be accomplished as described previously.

When it is time to close the upper flapper 46 and lower flapper 48, the pressure is removed from the lower control line 14. Initially, the support sleeve 70 moves downwardly with the lower sleeve 62. When the dogs 110 again become aligned with recess 112, the sleeve 62 moves relatively to the support sleeve 70 thus camming the dogs 110 into groove 112. From that point on the support sleeve 70 does not move any further. Eventually, the collets 94 encounter again the shoulder 108. However, without pressure on control line 14, the return spring 64 provides sufficient force to overcome spring 98 to allow the collets 94 to move into recess 116. With the collets 94 in recess 116, the can clear the shoulder 108. As soon as the collets 94 pass the shoulder 108, the spring 98 pushes them back out against raised surface 92. At that point, the sleeve 62 continues to move further downwardly under the power of return spring 64. Eventually, the collets 94 encounter the shoulder 118 and the same procedure occurs where the collets 94 are again forced into recess 116 to clear shoulder 118. After the collets 94 clear shoulder 118, spring 98 once again resets the collets in opposition to raised surface 92 which in turn traps the collets 94 against shoulder 96 to reassume the run-in position shown in FIGS. 4*a*–4*e*.

Those skilled in the art can see that in this preferred embodiment, the support sleeve 70 is locked out from movement until a discrete amount of movement of the support sleeve 62 occurs. It takes a predetermined pressure to compress the Belleville washers 102 to initiate any movement at all. The amount of washers in the stack 102 determines how much pressure at control line 14 is required to initially allow the collets 94 to move around the shoulder 96 to initiate initial movement. If pressure is held only at a predetermined level, the sleeve 62 stops its movement at a predetermined position which is denoted by the placement of shoulder 108. Thus, it takes a further increment in pressure to make the collets 94 once again overcome the force of the Belleville washer stack 102, which moves in tandem with the collets 94 and the sleeve 62. When that higher pressure increment is applied with the collets 94 trapped against shoulder 108, the further movement of sleeve 62 occurs, which allows the support sleeve 70 to become unlocked due to the unsupporting of dogs 110 when groove 114 is in alignment with them. When this occurs, the support sleeve 70 moves up finally into position to support the by-then-closed upper flapper 46.

It will be appreciated that the net result of both embodiments is the same, i.e., that the upper flapper 46 is supported by the support sleeve 70. However, the mechanical execution is slightly different, and the embodiment in FIGS. 4*a*–4*e* is preferred.

It should be noted that the individual operation of rotatably mounted flappers, such as 46 and 48, using spring-biased sleeves, is a technique that has been known in the art. The present invention employs the technique of actuation of flappers to create, in effect, a lubricator which can be leak-tested and which has approximately a length of 2,000 feet to greatly facilitate operations at the wellhead when further completion work is necessary.

The low profile of the flapper assembly 18 should also be noted. Often it is important to provide as much clearance as possible for the assembly that is put together above flappers 46 and 48. The apparatus and method of the present invention allows testing of two shutoffs for sealing integrity. Once such sealing integrity has been determined, applicable laws and regulations that require two certain shutoffs before opening of the wellhead for further operations are met. By use of the support sleeve 70, the problem of how to test a second flapper has been solved. It should be noted that while the use of a support sleeve 70 to hold flapper 46 in the closed position for a test from above has been disclosed, it is within the purview of the invention to use other techniques to temporarily hold closed the upper flapper 46 for a pressure test from the surface.

It should be noted that if the flapper closure sequence is reversed and flapper 46 is closed first and tested, it must be reopened in order to test the lower flapper 48. Once the upper flapper 46 is reopened, the previous test that has been done on it is invalid for purposes of compliance with regulations that require two positive shutoffs. Accordingly, the sequence described above is used where the lower flapper 48 is tested with well pressure and the upper flapper 46 is tested from above with a support holding it closed.

It should be noted that other ways to support the flapper 46 in the closed position apart from sleeve 70 can be employed. Such techniques may include any type of control on the pivot pin 50 to keep it momentarily from rotating during the test or the use of other styles of valves which can hold the closed position with a sleeve such as 70 or by other means.

The foregoing disclosure and description of the invention are illustrative and explanatory thereof, and various changes in the size, shape and materials, as well as in the details of the illustrated construction, may be made without departing from the spirit of the invention.

What is claimed is:

1. A method of performing a downhole operation from the surface and into wellbore tubing of a live well, comprising:

installing at least two fail-closed valves on wellbore tubing;

closing said valves;

pressure-testing each valve to determine that it does not leak;

using the space in the wellbore tubing above said valves to assemble downhole components.

2. The method of claim 1, further comprising:

using two valves assembled one above the other;

testing the lower of the two valves using formation pressure in the well;

testing the upper of the two valves from the surface of the well.

3. The method of claim 1, further comprising:

supporting at least one of said valves in a closed position for a leak test;

applying pressure from the surface of the well to said valve which is supported in a closed position to test it for leaks.

4. A method of performing a downhole operation from the surface and into wellbore tubing of a live well, comprising:

installing at least two valves on wellbore tubing;

closing said valves;

pressure-testing each valve to determine that it does not leak;

using the space in the wellbore tubing above said valves to assemble downhole components;

assembling said valves onto a body which is removably installed to the wellbore tubing;

using at least one pre-existing control line for a single valve in said wellbore tubing as a pressure source for operating said valve.

5. A method of performing a downhole operation from the surface and into wellbore tubing of a live well, comprising:

installing at least two valves on wellbore tubing;

closing said valves;

pressure-testing each valve to determine that it does not leak;

using the space in the wellbore tubing above said valves to assemble downhole components;

using at least one pre-existing control line in said wellbore tubing as a pressure source for operating said valve;

using a sliding sleeve to control the position of a first of said valves;

using said sliding sleeve to provide support for a second of said valves while said second valve is in a closed position.

6. The method of claim 5, further comprising:

using a support sleeve to hold said second valve open;

providing lost motion between said sliding sleeve on said first valve and said support sleeve.

7. The method of claim 6, further comprising:

moving said sliding sleeve using hydraulic pressure of a predetermined amount in a first of said control lines;

allowing said first valve to close by said movement of said sliding sleeve;

testing said first valve for leaks with well pressure.

8. The method of claim 7, further comprising:

moving a second sleeve with hydraulic pressure through a second of said control lines;

allowing said second valve to close by said movement of said second sleeve;

increasing pressure in said first control line beyond said predetermined amount;

moving said sliding sleeve beyond its initial movement which allowed said first valve to close;

putting said support sleeve in contact with said second valve, which is already closed, to support it in its closed position.

9. The method of claim 8, further comprising:

retaining said support sleeve to a body supporting said valves;

overcoming said retaining by movement of said sliding sleeve.

10. The method of claim 9, further comprising:

using at least one collet on said support sleeve to engage a groove in said body;

forcing said collet out of said groove by movement of said sliding sleeve.

11. The method of claim 10, further comprising:

putting together a downhole assembly in the wellbore above said valves when they are closed;

sealing around said downhole assembly near the wellhead;

retracting said support sleeve with said sliding sleeve;

opening said first valve by retraction of said sliding sleeve;

undermining support for said second valve by said retraction of said support sleeve;

opening said second valve by retraction of said second sleeve;

advancing a downhole assembly previously put together in said well above said valves, when closed, to another point in the well below said valves.

12. The method of claim 11, further comprising:

lifting said downhole assembly above said valves after conclusion of the downhole operation;

closing said valves;

pressure-testing said closed valves;

removing the downhole assembly from the wellbore;

removing said body which carries said valves from the wellbore.

13. The method of claim 9, further comprising:

using a dog to lock said support sleeve to said body;

unlocking said dog by movement of said sliding sleeve.

14. The method of claim 13, further comprising:

using a collet on said support sleeve;

trapping said collet on a first signal for run in;

overcoming the force of a stock of beveled washers;

allowing said collet to clear a shoulder by compression of said beveled washers;

trapping said collet on a second shoulder before said sliding sleeve can unlock said dog to allow said support sleeve to move.

15. A method of insertion of downhole equipment from the surface through a wellhead into a live well, comprising:

isolating a zone of well pressure at a point below the surface with a plurality of valves selectively placed in a closed position;

using a closure mechanism to selectively close one valve and selectively contact another valve;

assembling a downhole assembly in an unpressurized zone in the well above said isolated zone;

isolating said unpressurized zone at the wellhead;

allowing communication between said zones;

advancing said assembly into said previously isolated zone.

16. The method of claim 15, further comprising:

performing the downhole operation;

retracting said downhole assembly above said previously isolated pressure zone;

reisolating said zone in the wellbore;

venting pressure above said isolated zone;

removing said downhole assembly through the wellhead.

17. A method of insertion of downhole equipment into a live well, comprising:

isolating a zone of well pressure at a point below the surface;

assembling a downhole assembly in an unpressurized zone in the well above said isolated zone;

isolating said unpressurized zone at the surface;

allowing communication between said zones;

advancing said assembly into said previously isolated zone;

using at least two valves for said isolating and for testing said valves for leaks before said assembling;

using a removable body containing said at least two valves;

using at least one preexisting control line placed therefor operation of a single valve and running from the surface into a tubular in the wellbore for actuation of said valves.

18. The method of claim 17, further comprising:

closing a lower valve using at least a first of a plurality of control lines;

testing said lower valve using well pressure;

closing an upper valve using a second of a plurality of control lines;

testing said upper valve using pressure from the surface.

19. The method of claim 17, further comprising:

removing said body from the wellbore after removal of said downhole assembly.

20. A method of insertion of downhole equipment into a live well, comprising:

isolating a zone of well pressure at a point below the surface with a plurality of valves selectively placed in a closed position;

using a closure mechanism to selectively close one valve and selectively contact another valve;

assembling a downhole assembly in an unpressurized zone in the well above said isolated zone;

isolating said unpressurized zone at the surface;

allowing communication between said zones;

advancing said assembly into said previously isolated zone;

using a removable body containing said at least two valves;

using at least one preexisting control line running from the surface into a tubular in the wellbore for actuation of said valves;

closing a lower valve using at least a first of a plurality of control lines;

testing said lower valve using well pressure;

closing an upper valve using a second of a plurality of control lines;

testing said upper valve using pressure from the surface;

allowing said lower valve to close responsive to movement of a first sleeve;

allowing said second valve to close responsive to movement of a second sleeve;

using said first sleeve to support said upper valve when said upper valve is in its closed position to facilitate pressure testing from above.

21. The method of claim 20, further comprising:

using a support sleeve releasably supported by a body which also can support said upper valve;

mounting said support sleeve to said first sleeve with lost motion.

22. The method of claim 21, further comprising:

shifting said first sleeve to allow said lower valve to close for testing;

shifting said second sleeve before said support sleeve is moved;

allowing said upper valve to close before changing control line pressure to said first sleeve;

urging said first sleeve beyond the motion it took to close said lower valve;

moving said support sleeve with said first sleeve until support for said upper valve, which is already in the closed position, is achieved.

23. The method of claim 22, further comprising:

using at least one dog on said support sleeve removably engaged to a groove on said body for temporary support;

using a predetermined movement of said first sleeve to unsupport said dog for tandem movement of said first and said support sleeves;

retracting said support sleeve away from said upper valve using said first sleeve after said lost motion has concluded.

24. The method of claim 21, further comprising:

using a collet on said first sleeve initially trapped to said body;

applying fluid pressure to compress a stack of beveled washers to liberate said collet;

capturing said collet on said body at a second location prior to unsupporting said dog.

25. The method of claim 24, further comprising:

using a flapper-type valve for said upper and lower valves;

biasing said first and second sleeves to force said lower and upper valves, respectively, to pivot into the open position until pressure applied in said control lines overcomes said biasing and allows said valves to close.

* * * * *